313-414 SR
10/25/83 OR 4,412,149

United States Patent [19] [11] 4,412,149
Say [45] Oct. 25, 1983

[54] CRT FOCUSING ELECTRODE STRUCTURE

[75] Inventor: Donald L. Say, Waterloo, N.Y.

[73] Assignee: North American Philips Consumer Electronics Corp., New York, N.Y.

[21] Appl. No.: 303,751

[22] Filed: Sep. 21, 1981

[51] Int. Cl.[3] ..... H01J 29/50
[52] U.S. Cl. ..... 313/414; 313/409
[58] Field of Search ..... 313/414, 409, 413

[56] References Cited

U.S. PATENT DOCUMENTS 4,208,610 6/1980 Schwartz ..... 313/414
4,275,332 6/1981 Ashizaki et al. ..... 313/414
4,317,065 2/1982 Hughes ..... 313/414

*Primary Examiner*—Alfred E. Smith
*Assistant Examiner*—Carolyn E. Fields
*Attorney, Agent, or Firm*—Thomas M. Briody; Jack Oisher; John C. Fox

[57] ABSTRACT

An improved beam focusing structure, in the form of overlapping lenses, is incorporated into the forward portion of the unitized main focusing electrode of a compactly-dimensioned CRT three-beam in-line electron gun assembly. Such is accomplished by forming a common, elongated and configurated focusing electrode aperture to accommodate passage of the three beams therethrough. A pair of planar wall elements, spatially positioned in the aperture, to define the three lenses, have concave arcuately shaped forward edges formed in acccordance with the spacing between the focusing electrode and an adjacent plural apertured accelerating electrode.

5 Claims, 5 Drawing Figures

CRT FOCUSING ELECTRODE STRUCTURE

BACKGROUND OF THE INVENTION

1. Field of the Invention

This invention relates to focusing electrode structures for cathode ray tubes, and more particularly to focusing means in a multibeam in-line CRT electron gun assembly wherein efficient overlapping lenses are provided.

2. Prior Art

Advancements in cathode ray tube technology have fostered a trend toward miniaturization and compaction of electron gun structures, such structures in turn being encompassed within envelope neck portions of increasingly smaller diameters and shorter lengths. Consequently, the structural dimensions of the electrode elements of the gun assembly have been adapted to achieve the desired compaction. Such is especially evidenced in conventional in-line gun assemblies, wherein three separate electron beams emanate in a substantially common plane. This is conventionally accomplished by employing unit-type construction, wherein several functionally similar electrodes, ahead of individual cathodes, are combined as unitized structures to favor compaction.

In effecting miniaturization of in-line gun assemblies, factors influencing the quality of focusing of the individual electron beams become more critical as the diameters of the main focusing lenses, being positioned in-line in the horizontal plane of the assembly, are necessarily reduced to meet dimensional requirements. Consequently, the reduced in-line dimensioning tends to foster increased spherical aberration in the main focusing lenses. Thus, with such compaction of gun structures, it becomes much more difficult to consistently achieve the quality of efficient beam focusing needed to produce the desired small and round spot size beam impingement on the display screen.

Accordingly, objectives of the present invention include the provision of modified focusing electrode means for expeditiously effecting improved quality of beam focusing by reducing spherical aberration in the lenses or smaller types of in-line electron gun assemblies, such being accomplished while still achieving the desired in-line structural compaction. The improvement is realized in the unitized main focusing electrode structure which is discretely modified to beneficially accomodate lenses of larger diameters than commonly employed in a similar size structure.

SUMMARY OF THE INVENTION

Figure 1:
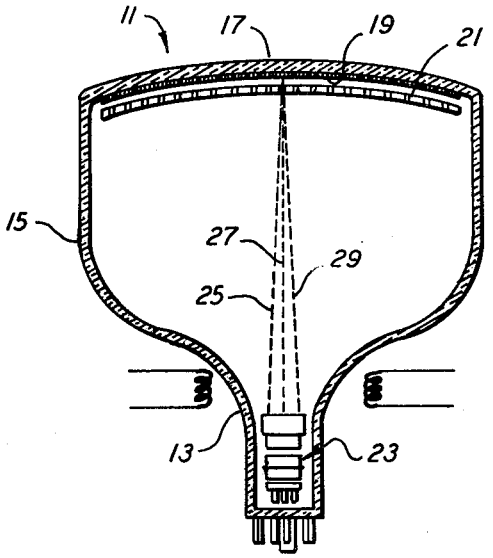
FIG. 1 is a sectioned elevation of a cathode ray tube wherein the invention is utilized.
Figure 3:
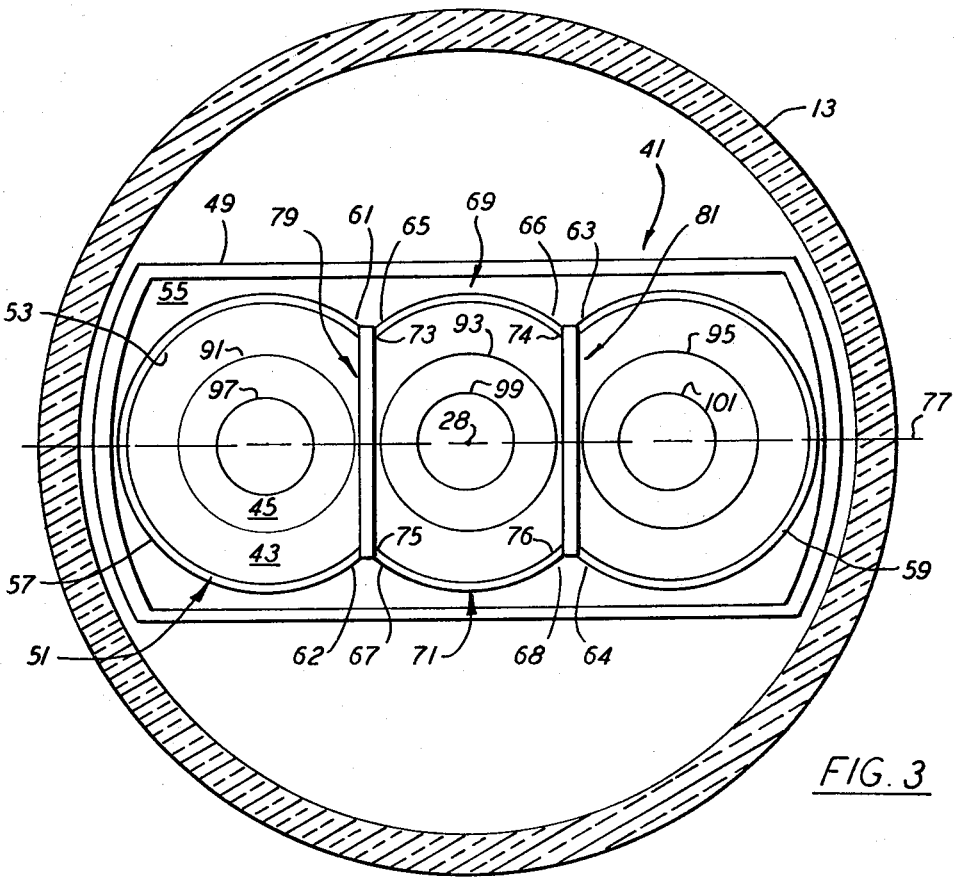
FIG. 3 is a plan view of the unitized main focusing electrode of the gun assembly, taken from the plane 3—3 in FIG. 2.
Figure 2:
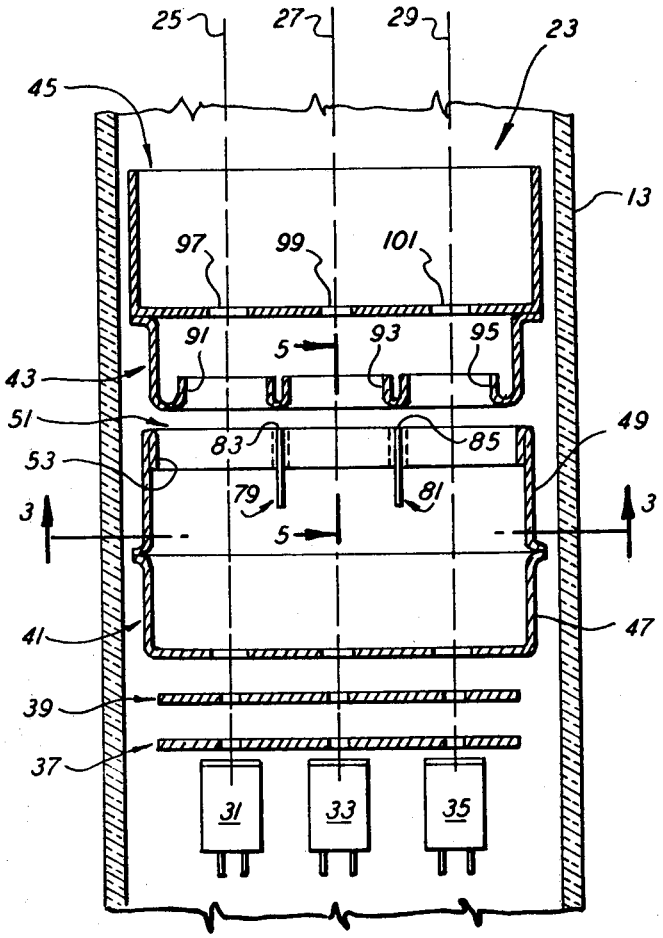
FIG. 2 is a partially sectioned view taken along the in-line plane of a unitized in-line plural beam electron gun assembly of the type employed in FIG. 1.

In accordance with the invention, a main focusing electrode structure for a CRT plural beam unitized in-line gun structure, is provided which enables substantial miniaturization of the gun structure without the accompanying focusing aberrations normally attendant thereto. The gun assembly embodies a center and two side-related integrated gun structures from which three beams emanate in a common plane. A gun assembly of this type is a construction of sequentially positioned in-line electrodes which include a forwardly positioned main focusing electrode and a terminally-related, plural-aperture final accelerating electrode.

The invention relates to means for beneficially modifying the lensing fields associated with the main focusing of each of the respective beams to minimize spherical aberrations affecting the focused beams, thereby producing small, round well-defined beam spot landings on the screen. To achieve this desired result, larger focusing lenses are utilized, and in order to accommodate them in the smaller dimensioned gun structures, the lenses are overlapped in a plane normal to the in-line plane of the focusing electrode. This is accomplished by structurally modifying substantially the forward portion of the main focusing electrode by forming a common, elongated, configurated aperture to accommodate the three adjacently-overlapped lenses associated with the three in-line beams. This aperture is comprised of three regions and defined by three in-line circles of equal diameters, each side circle partially overlapping the center circle by the same amount. The resulting aperture has two sets of projecting points or opposing cusps, corresponding to the points of intersection of the circumferences of the circles, which cusp sets are spanned by wall elements tending to define three separate regions of the single aperture.

Perimetrically, the configurated aperture is formed of peripherally in-turned projections or flanges extending substantially normal to the interior surface of the forward end of the focusing electrode. In greater detail, the configuration of the common aperture is delineated by a discretely shaped curvilinear perimeter. Such is comprised of substantially circular end apertural portions, for accommodating the side related beams, and arcuate side portions shaped as single opposed arcs to form a central apertural region to accommodate the center beam of the in-line formation. The mergings of the termini of the respective curvate end and side portions produce the pair of equi-spaced cusps which are instanding toward the in-line plane on either side of the configurated opening. These opposed pairs of cusps demarcate the three in-line apertural regions for the three beams traversing the common elongated aperture. The aforenoted arcuate side and circular end portions are delineated from the respective beam axes by substantially similar radii of values greater than the radii of the related individual apertures in the adjacent accelerating electrode.

The modification of the focusing electrode further embodies the placement of two like planar wall elements in equi-spaced parallel orientations on either side of the center beam axis, in a manner to effect jointure with the respective opposed cusps of the common three beam aperture. Each of these wall elements, being formed of a metallic material, such as a stainless steel, has a defined length extending into the focusing electrode and a width that is sufficient to bridge the opposed cusps, such width being greater than the diametrical dimension of a single aperture in the adjacent accelerating electrode. The forward edges of the walls evidence similar discrete shapings which provide a compensating focusing influence on the adjacent non-symmetrical overlapping lenses of the focusing electrode.

Preferably, the aforementioned discrete shaping of the width-related forward edge of each wall element is a concave arcuate formation delineated by a radius of a value less than the apertural radii of the focusing electrode and of a value greater than the individual apertural radii of the adjacent accelerating electrode. The termini of the arcuate edge of each wall element substantially abut the plane of the forward apertured end of the focusing electrode at the cusp formations.

In accordance with one aspect of the invention, the width of each of the wall elements is less than the diameter of a single apertural region of the common configurated aperture in the main focusing electrode.

Further, the length of each of the wall elements is of a value equal to or greater than 50 percent of the radii dimension delineating a single apertural region in the common configurated aperture. Additionally, the length need not substantially exceed the diameter of one of the like apertural regions comprising the common aperture.

In accordance with another aspect of the invention, the separation distance between the parallel wall elements in the focusing electrode is equal to or greater than the diameter of the center aperture in the adjacent accelerating electrode.

DESCRIPTION OF THE PREFERRED EMBODIMENT

For a fuller understanding of the present invention together with the objects, advantages and capabilities thereof, reference is made to the following disclosure and appended claims taken in conjunction with the aforedescribed drawings.

Referring now to FIG. 1 of the drawings, there is shown a color cathode ray tube (CRT) 11 of the type employing a plural beam in-line gun assembly. The envelope enclosure is comprised of an integration of neck 13, funnel 15 and viewing panel 17 portions. Disposed on the interior surface of the viewing panel is a patterned cathodoluminescent screen 19 formed as a repetitive array of definitive stripes or dots or color-emitting phosphor components, such being in keeping with the state of the art. A multi-opening structure 21, in this instance a shadow mask, is positioned within the viewing panel in spatial relationship to the patterned screen, such being located within the panel by conventional means, not shown.

Positionally encompassed within the envelope neck portion 13, is a unitized, plural beam in-line electron gun assembly 23, comprised of an integration of three side-by-side gun structures. The guns of this unitized assembly form and direct three separate electron beams 25, 27, and 29 to discretely impinge upon the patterned screen 19. It is within this electron gun assembly 23 that the improvement of the invention resides. More specifically, the improvement concerns modification of the unitized main focusing electrode structure of the gun assembly, which is functionally related to the unitized plural apertured final accelerating electrode thereof. While the invention pertains equally to bi-potential lens structures and extended field lens structures, such as tri-potential, uni-potential-bi-potential, and bi-potential-uni-potential, the bi-potential structure will be considered herein as exemplary.

To fully understand the significance of the invention, attention is directed to FIGS. 2 through 5 wherein the plural beam bi-potential in-line gun assembly 23 is illustrated in greater detail. This plural gun multi-electrode structure is unitized, in that, the in-line apertures for the three guns are contained in a common member for each of the respective electrode elements, as shown in sectioned FIG. 2. Each of the respective in-line oriented beams 25, 27 and 29 traverses a substantially longitudinal arrangement of several functionally related electrode members. For example, sequentially positioned ahead of individual cathode elements 31, 33 and 35 is a unitized initial beam forming electrode (G1) 37, an initial beam accelerator electrode (G2) 39, a main focusing electrode (G3) 41, and a final accelerating electrode (G4) 43. Terminally positioned on the open forward portion of the final accelerator is a common plural apertured convergence cup member 45. The several unitized electrodes comprising the gun assembly 23 are conventionally positioned and held in spaced relationship by a plurality of insulative support rods, not shown.

The structural aspects of the invention reside within the main focusing electrode (G3) 41. This unitized structure is usually fabricated of two slightly flanged cup-like parts, i.e., a rear portion 47 and a forward portion 49, of which the flanges are mated and joined as by welding. The three electron beams 25, 27, and 29 traverse this unitized member through apertures in both the rear and forward portions.

The invention involves structural modification of the forward portion 49 to provide overlapping in-line non-symmetrical lenses, thus enabling the utilization of larger diameter main focusing lenses than conventionally employed in the same size unitized electrode member. The modification embodies a common, elongated and configurated aperture 51 formed to accommodate the three adjacently-overlapped focusing lenses. This perimetrically configurated aperture is formed of peripherally in-turned projections or flanges 53 that extend substantially normal to the interior surface 55 of the forward end of the focusing member 41. The basic shaping of this aperture is delineated by circular end portions 57 and 59, the respective termini 61, 62, and 63, 64 of which, sequentially merge with the termini 65, 66 and 67, 68 of intermediate side portions formed of single opposed arcs 69 and 71. The merging of the denoted termini produces a pair of like equi-spaced projecting points or cusps 73, 74 and 75, 76 instanding toward the in-line plane 77 on either side of the configurated aperture 51. Thus, there are formed three in-line apertural regions of the common opening 51.

A further modification of the forward portion 49 of the main focusing electrode embodies the placement of two like planar wall elements 79 and 81 in equi-spaced parallel positions on either side of the center beam axis 28, in a manner to effect jointure with the respective opposed cusp formations 73, 75 and 74, 76 of the common aperture 51. Each of these wall elements has a defined length (L) and a width (W) sufficient to bridge the distance between the opposed cusps. The forward edge 83 and 85 of each wall evidences a like discrete shaping, preferably in the shape of a concave arc, of which the termini 87 and 88 (See FIG. 5) substantially abut the plane of the forward end of the focusing electrode 41.

In the final accelerating electrode (G4) 43, spaced adjacent to the main focusing electrode, the three individual in-line apertures 91, 93 and 95 therein are spatially related to the common focusing electrode aperture 51. The electron beams, upon traversing the accelerating electrode, then pass through apertures 97, 99 and 101 in the convergence cup 45.

The final focusing of each of the electron beams is accomplished by the lensing action formed inter-spatially between the main focusing (G3) and final accelerating (G4) electrodes 41 and 43, the influencing fields of which extend through the apertures into the respective electrodes. Inherencies in the dimensionally-reduced unitized constructions tend to introduce asymmetries into the main focusing fields. To overcome these abnormal influences, the aforementioned structural changes are incorporated into the region influencing the critical aspects of focusing.

Since the main focusing electrode (G3) 41 is operated at a lower potential, as for example 5 KV, than the adjacent final accelerating electrode (G4) 43, which is of a much higher potential, such as 25 KV, the electron beams move at much slower rates of speed through the focusing electrode. As a result, substantially 80 to 90 percent of the main focusing is achieved in the focusing electrode portion of the lensing fields. Therefore, any asymmetries introduced into the "G3" fields exert greater influences on the final focusing of the beams than does the subsequent "G4" fields, wherein the beams pass through at accelerated speeds and are therefore more immune to field asymmetries therein. Consequently, effecting the larger overlapping lens concept in the "G3" electrode, while substantially maintaining the conventional "G4" structural layout, beneficially remedies a deleterious focusing problems.

Figure 4:
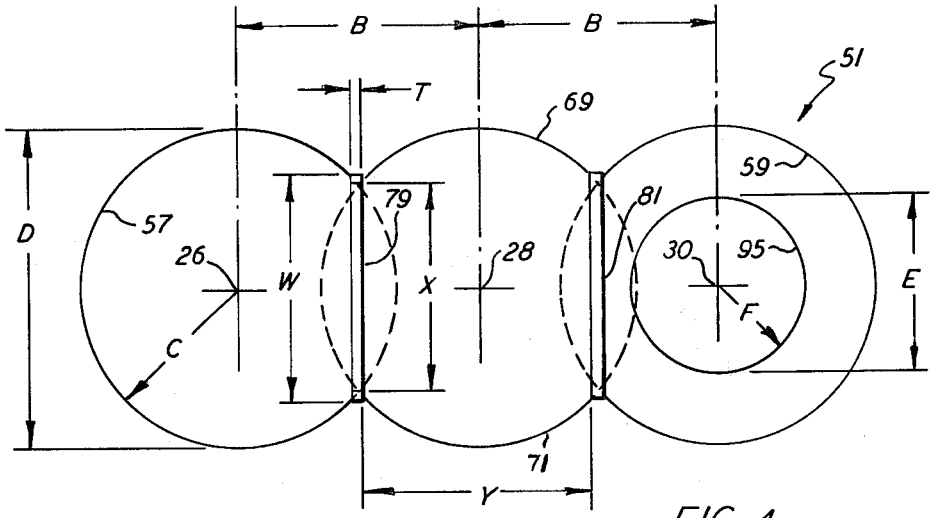
FIG. 4 is a diagrammatic illustration related to FIG. 3, wherein dimensions are delineated.

To further describe the invention in greater detail, exemplary related dimensional values and ratios are presented with reference to the drawings. FIG. 4 depicts the three overlapping lenses formed in the critical forward portion of the main focusing electrode 41, of which the contributing perimetric arcuate portions collectively demarcate the configurated shaping of the common aperture 51. The basic diameter of each lens or apertural region is designated by the dimension "D", and represents in this instance, a value of substantially 0.420 inch (10.67 mm). The equal separation between the respective beam axes 26, 28, and 30 is denoted as "B", being in the order of 0.325 inch (8.26 mm) or 0.77D. Adjacent lenses overlap by a chord dimension of "X", being a linear value of substantially 0.266 inch (6.76 mm) or 0.63D. The chord locations coincide with the positioning of the wall elements 79 and 81, whereof the width dimensions "W" are slightly longer than the chord dimensions to facilitate jointure with the respective cusps 73, 75 and 74, 76. The "W" designation has a value of substantially 0.300 inch (7.62 mm) or 0.71D. Each of the wall elements has a thickness "T" valued substantially as 0.020 inch (0.51 mm) or 0.47D. As shown, the two like wall elements are oriented in equispaced parallel positions on either side of the center beam axis 28, being separated by the distance "Y". This separation is equal to or greater than the diameter of the center aperture 93 in the adjacent accelerating electrode 43. As previously stated the individual apertures 91, 93, and 95 in the accelerator have like exemplary dimensional values "E" of substantially 0.250 inch (6.35 mm) or 0.60D. It is noted that the width "W" (0.71D) of each wall separator in the focusing electrode is greater than the individual diameters "E" of the accelerator apertures.

Figure 5:
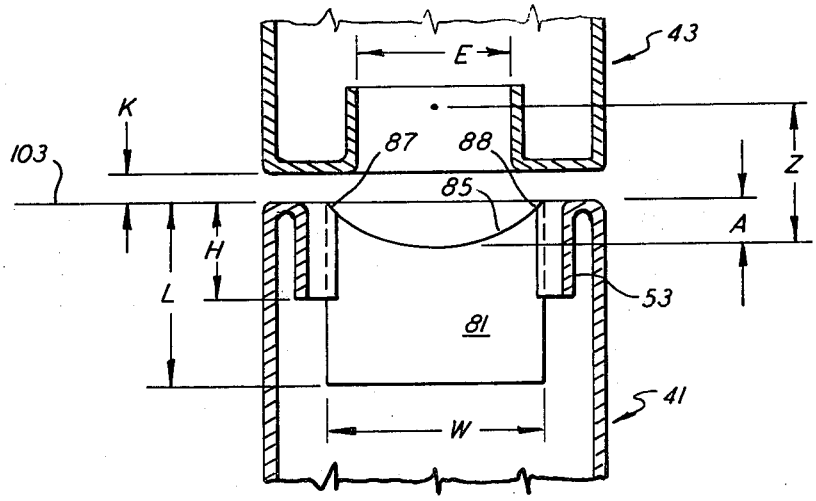
FIG. 5 is a cross-sectioned elevational view showing portions of the main focusing and accelerating electrodes illustrating the invention, such being taken along the plane 5—5 in FIG. 2.

The spacing "K" between the focusing and accelerating electrodes, in this instance, is in the order of 0.040 inch (1.02 mm) or 0.095D. To prevent overfocusing of the beams in the horizontal direction, which would produce an ovate spot landing on the screen, it has been found necessary to impart a concave arcuate shaping to the forward edge 85 of each wall element, such shaping being related to the aforenoted spacing "K". These discrete shapings provide beneficial compensating focusing influences on the overlapped lenses to effect the desired, small and well-formed round beam spot landings. This smooth arcuate formation of the forward wall edge 85, as delineated in FIG. 5, is defined by a radius "Z" of a value on the order of substantially 0.196 inch (4.98 mm) or 0.47D. The chord length of the arc, defined by termini 87 and 88, is the dimension "W" in FIGS. 4 and 5. The critical depth "A" of the chord area is a value of substantially 0.070 inch (1.78 mm) or 0.17D. It is noted that the forming radius "Z" of this arcuate edge is of a value less than the delineated apertural radii "C" (0.50D) constituting the common aperture 51, and of a value greater than the individual apertural radii "F" (0.30D) of the adjacent accelerating electrode. As previously noted, the termini 87 and 88 of the arcuately formed edge 85 of the wall element substantially abut the plane 103 of the forward end of the focusing electrode 41.

The length "L" of each of the wall elements is shown in FIG. 5, such being denoted inwardly from the forward plane 103 of the focusing electrode. The lengths of the two wall elements are substantially equal, and include the lengths "H" of the in-turned peripheral projections or flanges 53. The overall length "L" is of a value equal to or greater than 50 percent of the radial dimension "C" delineating a single apertural region of the common aperture 51. Additionally, the length "L" need not substantially exceed the diameter "D" of a single apertural region thereof.

Thus, markedly improved main focusing of in-line electron beams is facilely achieved by modifying the forward portion of the main focusing electrode in accordance with the interacting dimensional ratios and considerations described. The resultant large overlapping lenses provide beam focusing improvements heretofore unachieved in miniaturized and compacted gun structures. Since spherical aberration of electron lenses varies as the third power of lens diameter, small increases in lens diameter effect significant reduction in lens aberration.

INDUSTRIAL APPLICABILITY

The improved beam focusing effected by the invention is beneficially utilized in in-line color cathode ray tubes. The structural modification of the forward portion of the main focusing electrode can be achieved without increasing the dimensions of the desired compacted gun assembly.

I claim:

1. An improved beam focusing structure in a color CRT plural beam in-line electron gun assembly embodying a center and two side-related integrated gun structures from which said beams emanate on respective axes in a common in-line plane, said gun assembly being a construction of sequentially positioned in-line electrodes including a forwardly positioned main focusing electrode having rear and forward apertured ends and an adjacent terminally-related plural-apertured final accelerating electrode; said improved structure comprising means for beneficially modifying the lensing fields associated with the main focusing of each of the respective electron beams, said means comprising:

a common elongated perimetrically configurated aperture formed in the forward portion of said main focusing electrode to provide three adjacently overlapping in-line non-symmetrical focusing lenses thereat associated with the respective in-line beams, said perimetrically configurated aperture being formed of peripherally in-turned projections extending substantially normal to the interior surface of said forward end, said configurated aperture being delineated by circular end portions each having termini merging with those of opposed side-related arc portions to produce a pair of equi-spaced opposing cusps pointing toward said in-line plane on either side of said configurated aperture, thereby forming three apertural regions of said common elongated aperture, said arcuate side and circular end portions being delineated substantially from the respective beam axes by substantially similar radii of values greater than the radii of the related individual apertures in said adjacent accelerating electrode;

said means further comprising two like planar wall elements oriented in equi-spaced parallel position on either side of said center axis in a manner to effect jointure with opposed cusps of said aperture, each of said wall elements having a defined length extending into said focusing electrode and a width greater than the diameter of a single aperture in said adjacent accelerating electrode, said wall width being sufficient to bridge said opposed cusps but less than the diameter of a single apertural region of said common configurated aperture, with the forward edge thereof being a concave arcuate formation.

2. The improved structure according to claim 1 wherein the termini of each of said arcuate formations substantially abut the plane of the forward apertured end of said main focusing electrode at said cusps.

3. The improved structure according to claim 1 wherein said concave arcuate edge is formed by a radius of a value less than the delineated apertural radii constituting the common aperture of the focusing electrode and of a value greater than the individual apertural radii of the adjacent accelerating electrode.

4. The improved structure according to claim 1 wherein the separation distance between said parallel wall elements in said focusing electrode is equal to or greater than the diametrical dimension of the center aperture in said adjacent accelerating electrode.

5. The improved structure according to claim 1 wherein the length of each of said wall elements is of a value equal to or greater than 50 percent of the radial dimension delineating a single apertural region of said common configurated aperture, and wherein said length is substantially up to the diameter of a single apertural region thereof.

* * * * *